United States Patent [19]

Hovan et al.

[11] 4,023,350

[45] May 17, 1977

[54] EXHAUST CASE FOR A TURBINE MACHINE

[75] Inventors: Edward John Hovan, Manchester; Walter Ernest Bruetsch, East Hartford, both of Conn.

[73] Assignee: United Technologies Corporation, Hartford, Conn.

[22] Filed: Nov. 10, 1975

[21] Appl. No.: 630,565

[52] U.S. Cl. ..... 60/39.5; 415/210; 415/DIG. 1

[51] Int. Cl.[2] ..... F02C 7/00; F01D 25/30

[58] Field of Search ..... 60/39.5, 39.31; 415/210, DIG. 1

[56] References Cited

UNITED STATES PATENTS

| | | | |
|---|---|---|---|
| 2,558,816 | 7/1951 | Bruynes | 60/39.72 R |
| 2,608,821 | 9/1952 | Hunsaker | 60/39.31 |
| 2,788,803 | 4/1957 | Greene | 60/39.5 |
| 2,799,472 | 7/1957 | Rainbow | 60/39.5 |
| 2,844,001 | 7/1958 | Alford | 60/39.5 |

OTHER PUBLICATIONS

R. A. Wallis, *Axial Flow Fans*, London, 1961, pp. 98–99.

United Aircraft Corp. Research Report, M–15038–1, 2/16/48.

*Primary Examiner*—Carlton R. Croyle
*Assistant Examiner*—L. J. Casaregola
*Attorney, Agent, or Firm*—Robert C. Walker

[57] ABSTRACT

Apparatus for reducing the pressure loss imposed upon the working medium gases flowing through an exhaust case of a turbine machine is disclosed. Various construction details which reduce the cross flow of secondary air from the pressure side of one case strut to the opposing side of the adjacent strut are developed. The loss reduction system is built around vortex generators which energize the flow boundary layer at the inner wall of the flow path for the working medium gases.

8 Claims, 4 Drawing Figures

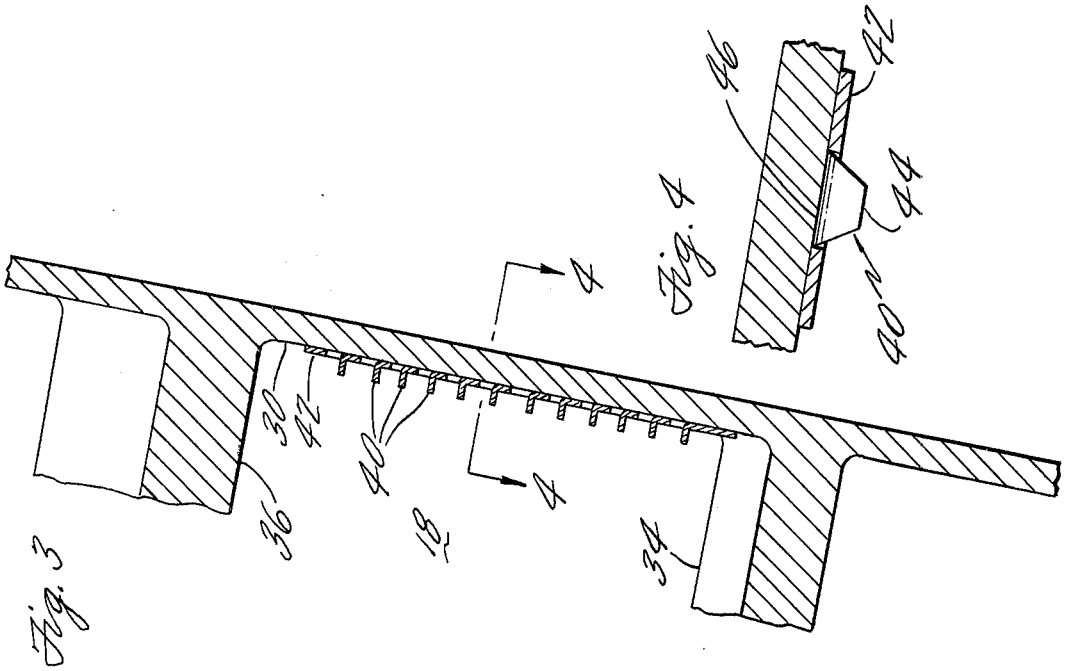
Fig. 3
30
42
40
36
18
4
4
34
Fig. 4
46
42
44
40
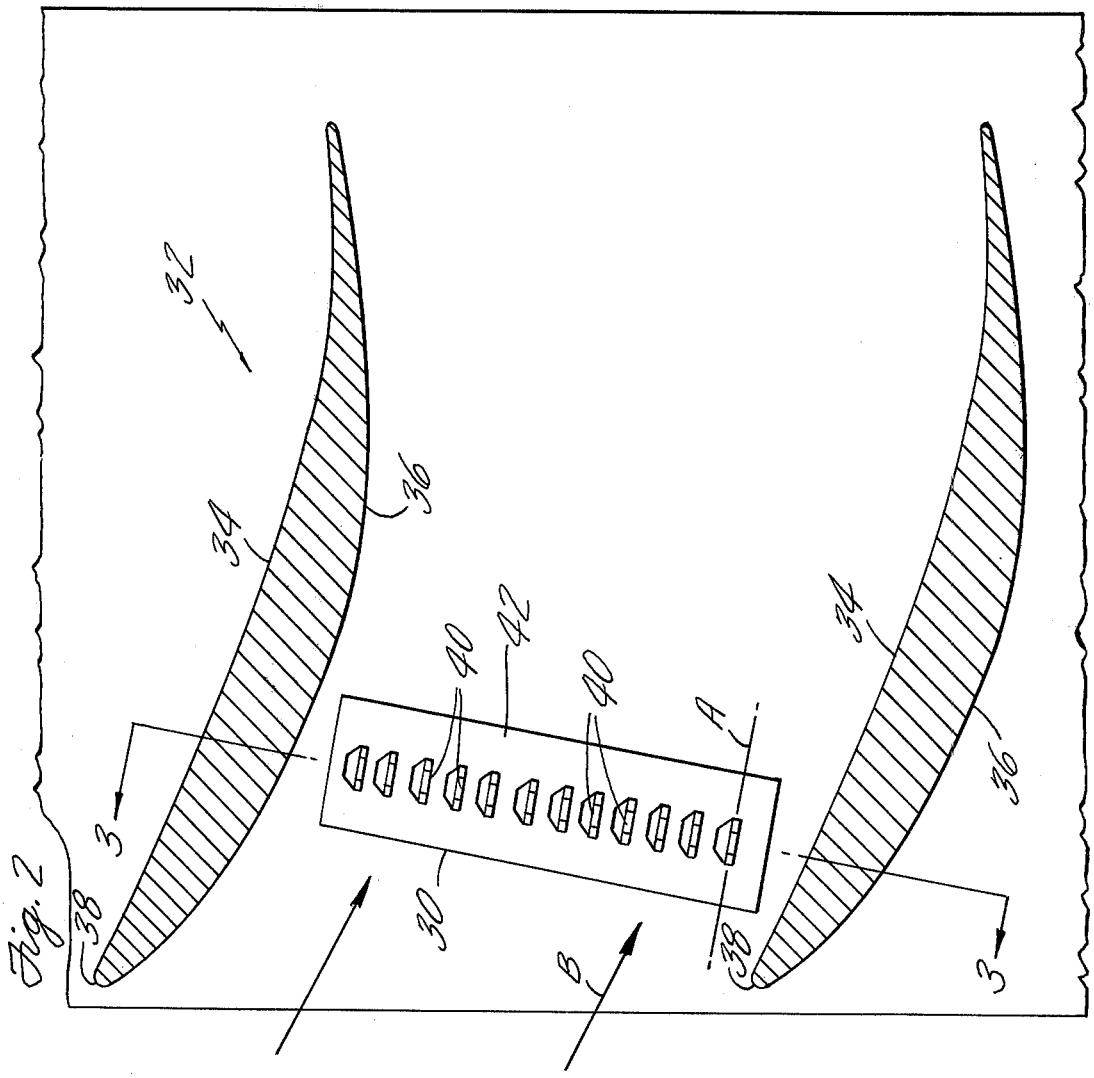
Fig. 2
32
34
36
38
3
40
42
40
30
A
B
38
34
36
3

EXHAUST CASE FOR A TURBINE MACHINE

BACKGROUND OF THE INVENTION

1. Field of the Invention

This invention relates to turbine machines and particularly to the flow losses imposed upon the working medium gases within the turbine exhaust case of such a machine.

2. Description of the Prior Art

A gas turbine engine is typical of turbine machines having an exhaust case through which working medium gases are flowed during operation of the engine. The exhaust case of such a machine conventionally comprises an inner cylindrical member forming the inner wall of the working medium flow path and an outer cylindrical member forming the outer wall of the flow path. A plurality of radially extending struts spans the flow path between the inner and outer cylinders to concentrically support the inner member.

Working medium gases discharging from the turbine into the exhaust case during operation of the machine have a residual velocity component in the tangential direction with respect to the inner wall of the flow path. The tangential velocity component of the medium gases detracts from the momentum increase producing a forward axial thrust and, in a gas turbine engine, is undesirable.

Conversion of the tangential velocity to axial velocity increases the axial thrust produced and is essential for optimum operation of the engine. In many constructions the tangentially flowing gases are redirected axially by the struts of the exhaust case. The struts are contoured to effect aerodynamically efficient turning of the flow. Resultantly, the flow path area between each pair of adjacent struts, as presented to the approaching medium, is less than the downstream discharge area between the struts and diffusion of the medium gases occurs during the turning process. During diffusion the velocity of the medium gases is slowed and the thickness of the boundary layer adjacent the radial walls increases.

The boundary layer is characterized by low velocity flows which vary in direction with respect to the mainstream velocity according to local pressure gradients within the boundary layer. The local pressure of the gases at any location within the boundary layer is that pressure which is imposed radially upon the boundary layer by pressure forces within the mainstream. In a region adjacent the pressure side surface of a case strut, the pressure forces within the mainstream are increased to include ram effects and that pressure is imposed radially upon the gases within the boundary layer. A pressure gradient between the pressure side surface of one strut and the opposing suction side surface of the adjacent strut is established.

The established circumferential pressure gradient encourages secondary flow of medium gases circumferentially about the inner wall through the boundary layer. One skilled in the art will recognize that the amount of secondary flow increases as the thickness of the boundary layer increases. Where a thick boundary layer is formed significant secondary flow occurs. The secondary flow runs askew to the mainstream flow and interfaces with the mainstream flow creating a zone of substantial turbulence. Aerodynamic mixing losses in the zone of turbulence are imposed upon the working medium gases and reduced overall engine performance results.

Continuing efforts are underway to decrease the mixing losses imposed upon the medium gases by reducing the amount of secondary flow within the exhaust case.

SUMMARY OF THE INVENTION

A primary aim of the present invention is to improve the operating efficiency of a turbine machine. Minimizing the pressure loss imposed upon the medium gases flowing through the turbine exhaust case is one goal. A reduction in the flow of secondary air between the turbine exhaust case struts is sought, and in one aspect, a specific object is to reduce the thickness of the boundary layer adjacent to the inner wall of the exhaust case.

According to the present invention a multiplicity of vortex generators are disposed about the inner wall of the flow path for the working medium gases in a turbine exhaust case to reduce the amount of secondary air flowing circumferentially between adjacent struts of the case.

A primary feature of the present invention is the vortex generators which are disposed circumferentially about the inner wall of the working medium flow path in the turbine exhaust case. In one embodiment a plurality of the vortex generators are fabricated from a strip of sheet metal material. Each strip of generators is affixed, as by welding, to the inner wall of the exhaust case between a pair of adjacent struts. The plane of each vortex generator is oriented at an angle $\theta$ with respect to the approaching flow of working medium gases.

A primary advantage of the present invention is a reduction in the circumferential flow of secondary air through the boundary layer along the inner wall of the working medium flow path. A reduction in the flow of secondary air decreases the aerodynamic mixing loss imposed upon the working medium gases flowing axially through the case. The reduction in aerodynamic mixing losses improves the overall cycle efficiency of the engine.

The foregoing, and other objects, features and advantages of the present invention will become more apparent in the light of the following detailed description of the preferred embodiment thereof as shown in the accompanying drawing.

BRIEF DESCRIPTION OF THE DRAWING

FIG. 2 is a sectional view taken along the line 2—2 as shown in FIG. 1 which illustrates the location of the vortex generators between adjacent struts;

FIG. 3 is a sectional view taken along the line 3—3 as shown in FIG. 2 which illustrates the protrusion of the vortex generators into the working medium flow paths; and FIG. 4 is an enlarged sectional view taken along the line 4—4 as shown in FIG. 3 which illustrates the geometry of a typical vortex generator.

DESCRIPTION OF THE PREFERRED EMBODIMENT

Figure 1:
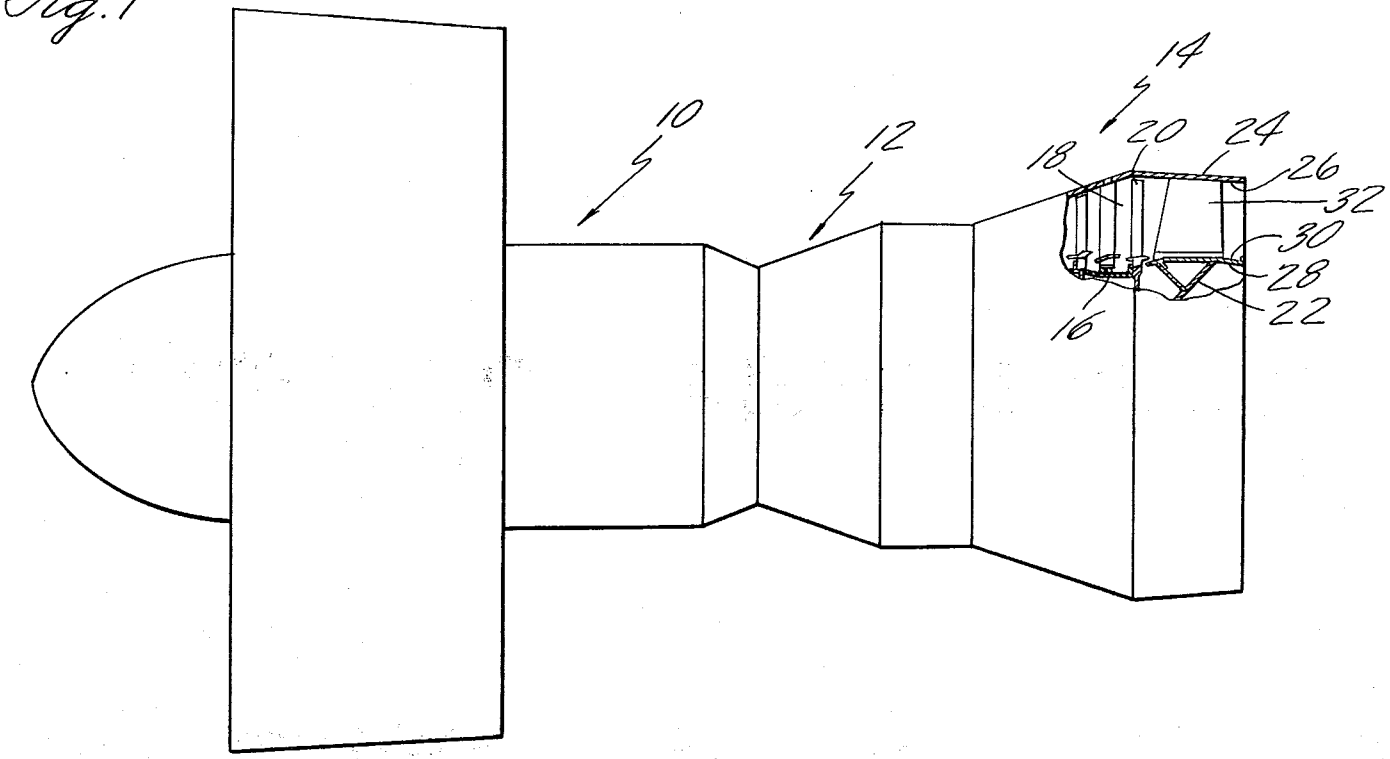
FIG. 1 is a simplified side elevation view of a gas turbine engine with a portion of the turbine exhaust case broken away to reveal the internal structure of the engine.

The turbofan, gas turbine engine shown in FIG. 1 is typical of turbine machines in which the overall engine performance is improved through incorporation of apparatus embodying the concepts described herein. Air is compressed in a compression section 10 at the upstream end of the engine. Compressed air is subsequently combined with fuel and burned in a combustion section 12 to increase the thermal energy of the air flowing therethrough. The effluent from the combustion section comprises the working medium gases which are expanded through a turbine section 14. Energy is removed from the working medium gases by a turbine rotor 16 which drives a compressor in the compression section. The rotor has one or more rows of rotor blades, which extend across a working medium flow path 18, including a last row of rotor blades 20. The expanded gases discharging from the last row of rotor blades are flowed axially within the medium flow path through a turbine exhaust case 22 and are discharged to the ambient atmosphere. The turbine exhaust case is formed of an outer cylndrical member 24 having an inwardly facing circumferential surface 26 which is the outer wall of the flow path for the working medium gases. An inner cylindrical member 28 of a case has an outwardly facing circumferential surface 30 which is in the inner wall of the flow path for the working medium gases. A plurality of struts 32, as represented by a single strut shown in FIG. 1, extends between the inner and outer cylindrical members. Each strut has a pressure side surface 34 and a suction side surface 36. A leading edge 38 of the strut faces in the upstream direction with respect to the approaching flow.

As is shown in FIG. 3, a multiplicity of vortex generators 40 extend radially into the flow path 18 for the working medium gases. In the embodiment shown the vortex generators are deformed upwardly from a material strip 42. As is viewable in FIG. 2 the material strip is attached to the outwardly facing surface 30 of the inner cylindrical member 28. Each strip 42 is disposed between a pair of adjacent struts 32 and is oriented so as to render the plane (A) of each vortex generator in an oblique relationship to the direction (B) of the approaching flow.

In one embodiment of the invention each vortex generator has a trapezoidal geometry including a tip chord 44 and a root chord 46.

During operation of the engine the working medium gases are discharged from the last row of rotor blades 20 into the turbine exhaust case. The gases discharged carry a residual swirl into the exhaust case. Diffusion of the gases as the swirling flow is conformed to axial flow by the struts causes a predominant portion of the flow, herein referred to as mainstream gases, to be carried away from the inner wall of the flow path. A boundary layer develops between the mainstream flow and the inner wall. The pressure of the mainstream gases adjacent the pressure wall of one strut is greater than the pressure of the mainstream gases adjacent the opposing suction surface of the adjacent strut. The radial pressure gradient between the suction and pressure walls is imposed upon the boundary layer causing a flow of secondary gases within the boundary layer from the pressure wall to the suction wall. The flow of secondary gases runs askew to the flow of mainstream gases and substantial turbulence is generated therebetween. As is discussed in the prior art section of this specification, aerodynamic mixing losses in the zone of turbulence dissipate a portion of the energy of the flowing medium and reduced operating efficiency results.

The vortex generators of the present invention extend from the inner wall, penetrate the boundary layer, and intercept a portion of the mainstream gases. The intercepted gases are impelled by locally generated vortices into the boundary layer. The outer portion of the boundary layer becomes energized as the mainstream gases are flowed thereto. Energizing the boundary layer replaces the low velocity gases of the boundary layer with the high velocity gases of the axially flowing mainstream. The thickness of the boundary layer is reduced and the flow of secondary gases circumferentially between the pressure side surface of one strut and the opposing suction side surface of the adjacent strut is inhibited.

In one preferred construction, the vortex generators are fabricated from a strip of sheet stock material. In the fabrication process the vortex generators are partially punched from the sheet stock and are deformed to an angle of 90° with the strip. Sheet metal having a thickness of approximately 0.020 of an inch is particularly well suited to the fabrication processes described herein, although one skilled in the art will recognize that other materials and fabrication processes having thermal suitability with the exhaust case environment may alternatively be utilized.

As is shown in FIG. 4, the vortex generator in one embodiment has a trapezoidal shape. The trapezoidal shape places a larger vortex generator surface area near the inner wall where the axial velocity of the medium gases is the lowest. A root chord 46 to tip chord 44 ratio of approximately 2 has been shown experimentally to be particularly effective. In one preferred geometry, a trapezoidal generator having a root chord of approximately 0.250 of an inch and a height of approximately 0.100 of an inch was successfully utilized.

The plane (A) of each vortex is disposed of an angle of approximately 16° to the direction of approaching flow in one embodiment; however, it is expected that an angle $\theta$ between 12° and 20° will also be effective in reducing the boundary layer thickness.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of our invention, that which we claim as new and desire to secure by Letters Patent of the United States is:

1. Apparatus for reducing the secondary flow of working medium gases circumferentially between the struts of a turbine exhaust case having an outer cylindrical member and an inner cylindrical member which conjunctively form a flow path for the working medium gases therebetween, including a plurality of vortex generators extending from a single strip of metal material radially outward from the inner cylindrical member into the flow path for the medium gases between each pair of adjacent struts to intercept an axially flowing portion of said gases and direct said axially flowing portion into the flow boundary layer adjacent the inner cylindrical member to inhibit the flow of secondary gases by reducing the thickness of the boundary layer.

2. The invention according to claim 1 wherein said strip of sheet metal extends from a point adjacent the leading edge of one strut to a point near the mid-chord of the adjacent strut.

3. The invention according to claim 1 wherein the sheet metal material has a thickness of approximately 0.020 of an inch and each vortex generator is deformed upwardly therefrom to an angle of approximately 90°.

4. The invention according to claim 1 wherein each vortex generator is an equilateral trapezoid having a base of approximately one quarter of an inch and a height of approximately one tenth of an inch.

5. The invention according to claim 1 wherein the metal strip is afixed to the outwardly facing surface of said inner member.

6. The invention according to claim 1 wherein the plane of each vortex generator is inclined at an angle with respect to the approaching flow of medium gases which is within the range of 12° to 20°.

7. The invention according to claim 6 wherein the plane of each vortex generator is inclined at an angle of approximately 16° with respect to the approaching flow of medium gases.

8. A turbine exhaust case comprising:

an outer member having an inwardly facing surface which is substantially cylindrical and which forms the outer wall of a flow path for the working medium gases;

an inner member having an outwardly facing surface which is substantially cylindrical and which forms the inner wall of the flow path for the working medium gases;

a plurality of struts which extend radially across the flow path from said outer member to said inner member; and a plurality of vortex generators extending from a single strip of metal material into the flow path for the medium gases between each pair of adjacent stuts from the outwardly facing surface to energize the boundary layer of the working medium gases which flow over said surface during operation of the engine.

* * * * *